US007380849B2

(12) United States Patent
Mongan

(10) Patent No.: US 7,380,849 B2
(45) Date of Patent: Jun. 3, 2008

(54) REMOTE RELEASE APPARATUS AND METHOD FOR LIFTING AND RELEASING A LOAD

(75) Inventor: Dan Eugene Mongan, Oregon, IL (US)

(73) Assignee: The Caldwell Group, Inc., Rockford, IL (US)

( * ) Notice: Subject to any disclaimer, the term of this patent is extended or adjusted under 35 U.S.C. 154(b) by 332 days.

(21) Appl. No.: 11/257,329

(22) Filed: Oct. 24, 2005

(65) Prior Publication Data

US 2006/0087137 A1 Apr. 27, 2006

Related U.S. Application Data

(60) Provisional application No. 60/621,773, filed on Oct. 25, 2004.

(51) Int. Cl.
*B66C 1/34* (2006.01)

(52) U.S. Cl. ..... 294/82.35; 294/81.5

(58) Field of Classification Search ..... 294/82.23, 294/82.24, 82.33, 82.35, 82.31, 82.34, 905, 294/81.1, 81.5
See application file for complete search history.

(56) References Cited

U.S. PATENT DOCUMENTS 2,595,450 A * 5/1952 Coffing ..... 294/82.33
2,858,161 A * 10/1958 Smith ..... 294/82.33
3,656,796 A * 4/1972 Cook ..... 294/81.56
3,883,170 A * 5/1975 Fricker et al. ..... 294/82.35
3,895,836 A 7/1975 Barnes
3,964,777 A * 6/1976 Lindqvist ..... 294/82.3
4,358,146 A * 11/1982 Goudey ..... 294/82.33
4,441,750 A * 4/1984 Reber ..... 294/82.24
5,244,243 A * 9/1993 Grayson et al. ..... 294/89
5,762,389 A 6/1998 Marler
5,791,710 A 8/1998 Marler
6,024,394 A 2/2000 Marler
6,654,990 B2 * 12/2003 Liu ..... 24/598.5

* cited by examiner

*Primary Examiner*—Dean J Kramer
(74) *Attorney, Agent, or Firm*—Reinhart Boerner Van Deuren P.C.

(57) ABSTRACT

A method and apparatus suspend a load on an arcuate shaped lift arm, which is attached to a body of a lifting apparatus in such a manner that the lift arm is movable with respect to the body of the apparatus along an arc, for selectively engaging and disengaging the load. The lift arm is locked against movement while the lift arm is supporting the load, and a remote release apparatus is provided for moving the lift arm along the arc. A second locking apparatus selectively locks the lift arm in place along the arc at an open position of the apparatus. The lifting apparatus may also include one or more remote release apparatuses, in combination with other elements such as a spreader bar, slings, and control elements.

39 Claims, 8 Drawing Sheets

REMOTE RELEASE APPARATUS AND METHOD FOR LIFTING AND RELEASING A LOAD

CROSS-REFERENCE TO RELATED PATENT APPLICATIONS

This patent application claims the benefit of U.S. Provisional Patent Application No. 60/621,773, filed Oct. 25, 2004, the disclosure and teachings of which are incorporated herein in their entirety.

FIELD OF THE INVENTION

This invention relates generally to lifting and placement of loads, such as structural beams and trusses, with a lifting mechanism such as a crane, and more particularly to an apparatus and method for lifting a load into place, using a sling, and releasing the load from the sling, after the load has been set in place, from a location remote from the remote release apparatus.

BACKGROUND OF THE INVENTION

It is common practice in the construction of buildings and the like to use a lifting mechanism, such as a crane, to lift structural beams, trusses, or other loads to a location that is often high above the ground. Often the load is attached to a lifting hook of the crane by one or more slings positioned to support the load while it is being lifted into place.

Once the load has been moved to the desired location, it is necessary to release it from the slings. Particularly where the load is being placed at an elevated location, it is highly desirable that an apparatus and method be provided for remotely releasing the load from the slings, so that, for example, a workman standing on the ground can release the load.

Safe practices and regulations typically make it inadvisable to have a workman located in the area where the load is to be placed, while the load is being lifted into place, particularly where the load is to be placed in an elevated location. As a result, if no apparatus or method is provided for remotely releasing the load, a workman may need to climb the structure to release the load after it has been set in place, and then descend to the ground before another load can be lifted into place. This results in considerable lost time and effort, particularly where a large number of heavy loads, such as beams and trusses, must be lifted into place and properly positioned at an elevated level.

It is also highly desirable that a remote release apparatus and method provide positive locking of the release apparatus whenever the slings are supporting the load, so that it cannot be inadvertently released while being lifted into place. It is further desirable, in some circumstances, that such a remote release apparatus and method include other components, such as spreader beams, slings, and control components, to form a lifting apparatus.

Prior approaches to providing such a remote release apparatus, and lifting apparatuses including such a remote release apparatus, have not been entirely satisfactory for meeting the needs outlined above. Such prior approaches are exemplified by: U.S. Pat. No. 3,895,836, to Barnes, entitled Structural Member Lifting And Releasing Device; U.S. Pat. No. 5,762,389, to Marler, entitled Apparatus For Latching And Unlatching A Load Suspended From A Lifting Crane; U.S. Pat. No. 5,791,710, to Marler, entitled Apparatus For Latching And Unlatching A Load Suspended From A Lifting Crane; and, U.S. Pat. No. 6,024,394, to Marler, entitled Apparatus With A Centering Member For Latching And Unlatching A Load Suspended From A Lifting Crane;

It is desirable, therefore, to provide an improved apparatus and method for lifting a load, and for remotely releasing the load once it has been set in place, in a manner that better fulfills one or more of the needs described above.

BRIEF SUMMARY OF THE INVENTION

The invention provides an improved method and apparatus for lifting a load into place, and for releasing the load, after it has been set in place, from a location remote from the remote release apparatus. In one form of the invention, an apparatus and method are provided for lifting a load into place using a sling, and for releasing the load from the sling, after the load has been set in place, from a location remote from the remote release apparatus. The remote release may be manually actuated, by pulling on a release cord, for example. The remote release may apparatus may include an actuator, controlled through wires or wirelessly from a controller located remotely from the remote release apparatus.

According to one aspect of the invention, a load is suspended on an arcuate shaped lift arm, which is attached to a body of a lifting apparatus in such a manner that the lift arm is movable with respect to the body of the apparatus along an arc, for selectively engaging and disengaging the load. The apparatus may also include a locking apparatus for locking the lift arm against movement while the apparatus is supporting the load on the lift arm, and/or a remote release apparatus for moving the lift arm along the arc. An apparatus according to the invention may also include a second locking apparatus for selectively locking the lift arm in place along the arc at an open position of the apparatus.

In some forms of the invention, a lifting apparatus, including one or more remote release apparatuses according to the invention, in combination with other elements such as a spreader beam, slings, and/or control elements, is provided.

Other aspects, objectives and advantages of the invention will become more apparent from the following description of the invention, in conjunction with the accompanying drawings.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention. The disclosure provided by all patents or other documents referenced herein or in the attachments is incorporated herein by reference.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
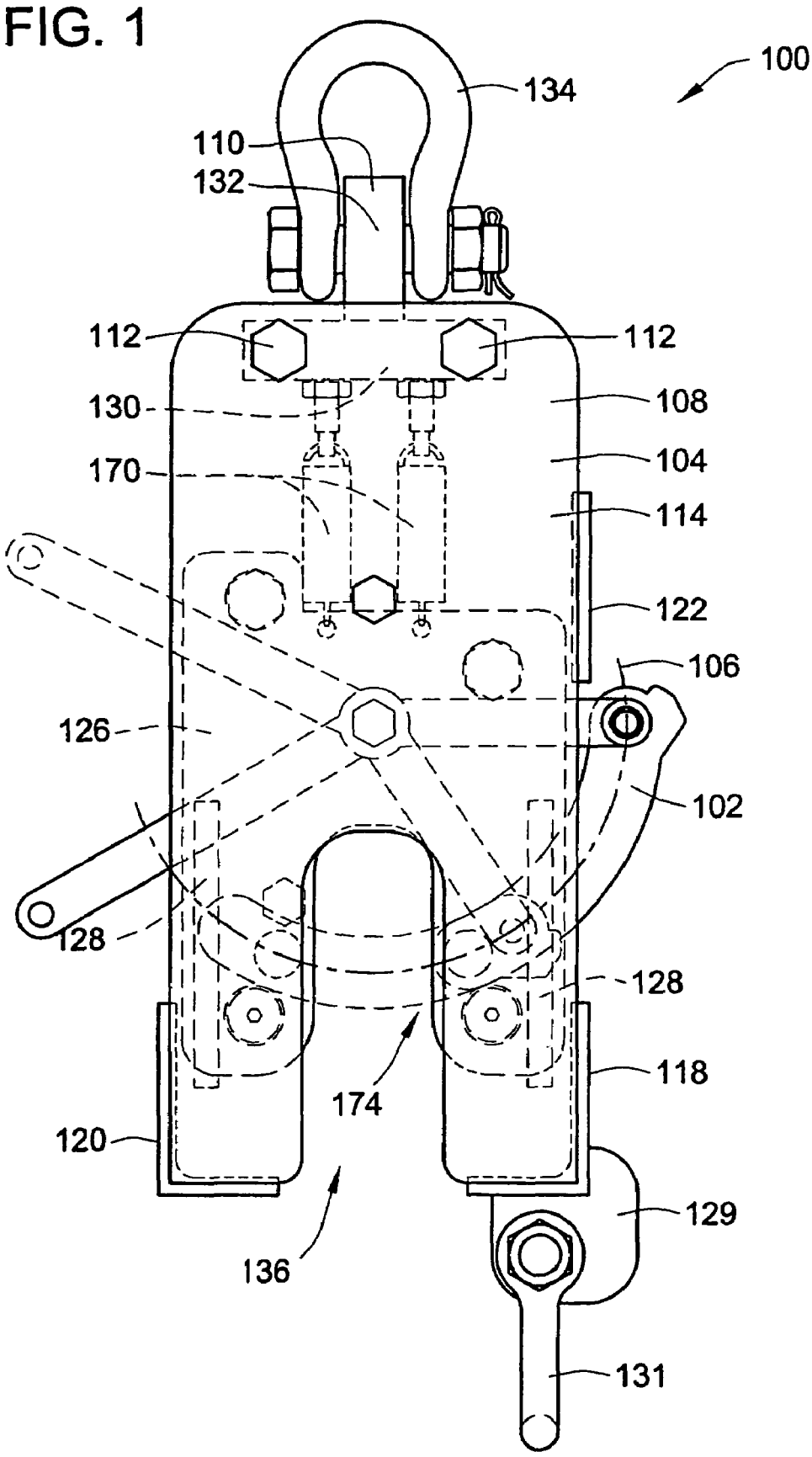
FIG. 1 is a front view of an exemplary embodiment of a remote release apparatus, according to the invention.
Figure 2:
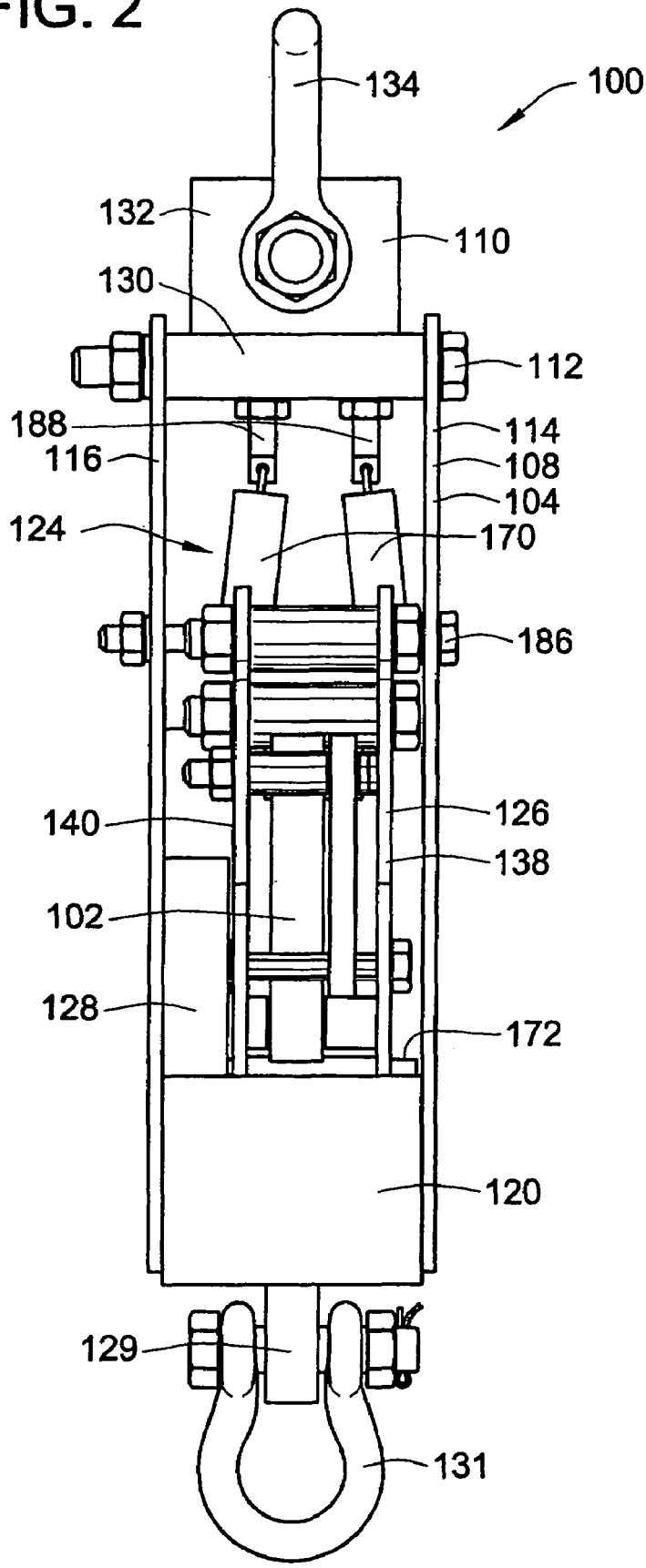
FIG. 2 is a left side view of the remote release apparatus of FIG. 1.
Figure 3:
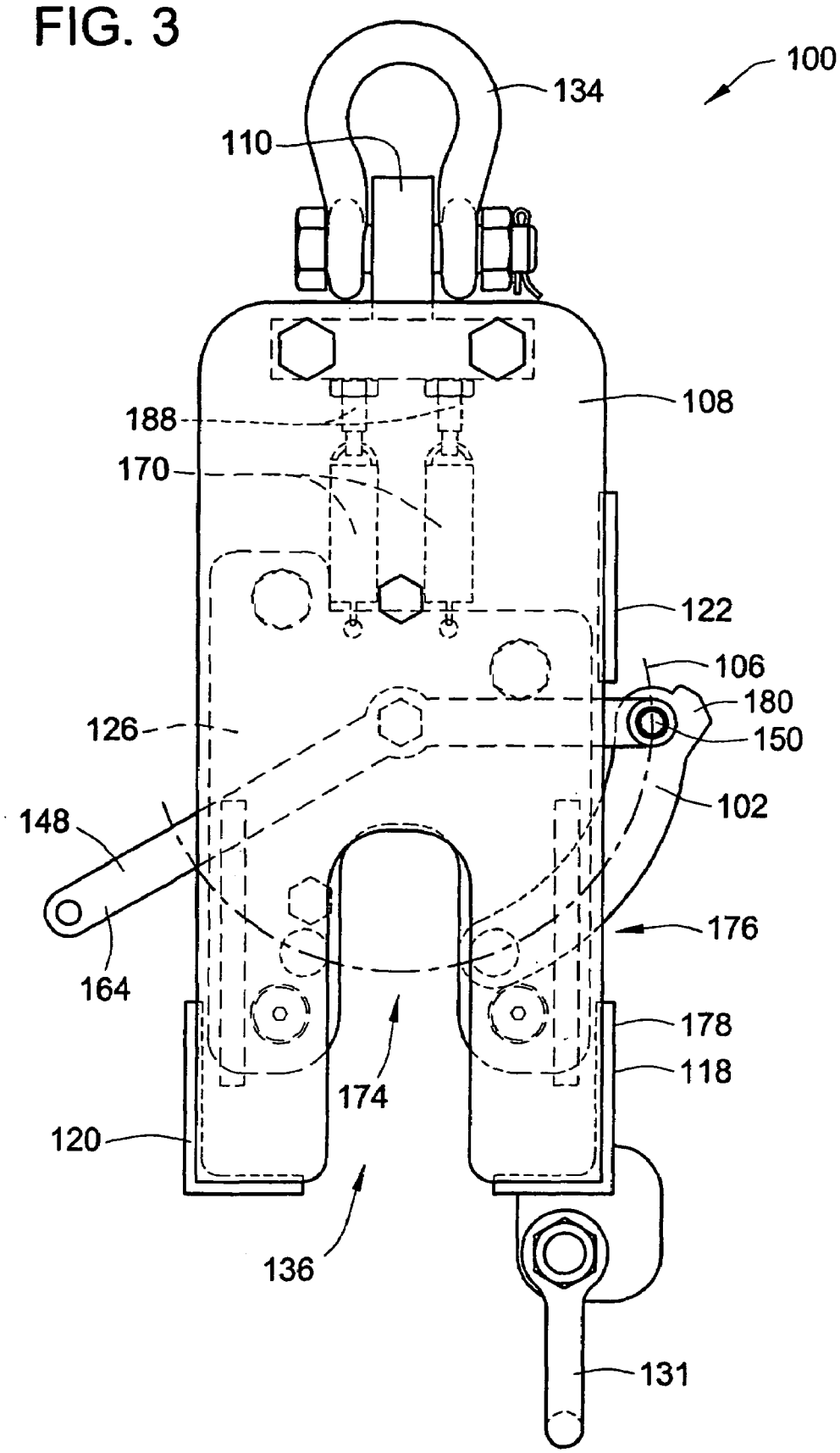
FIG. 3 is front view of the remote release of FIG. 1, in an open position.
Figure 4:
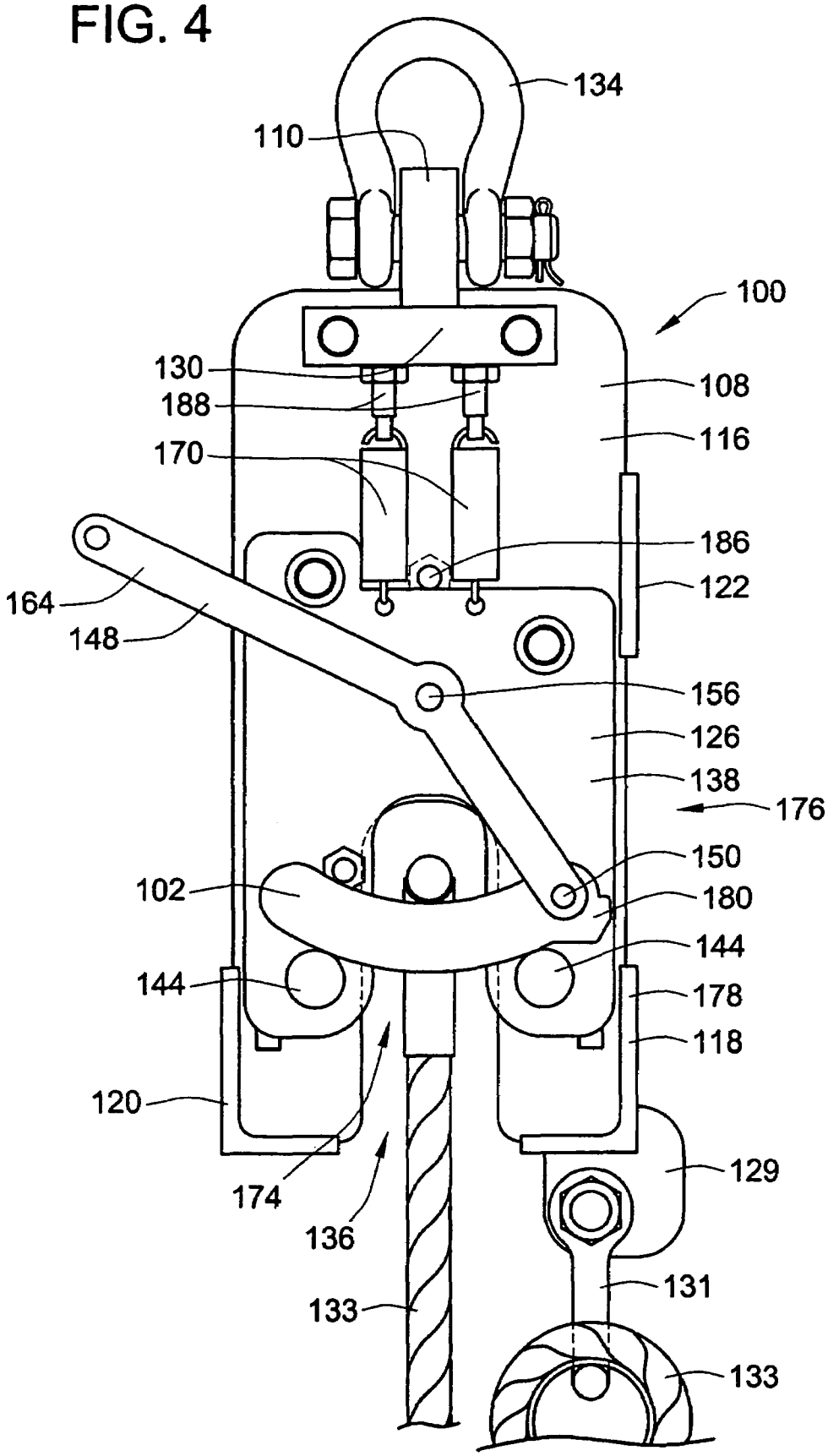
FIG. 4 is cross sectional view of the remote release of FIG. 1, looking from the front, with the remote release in closed-but-not-locked position.
Figure 5:
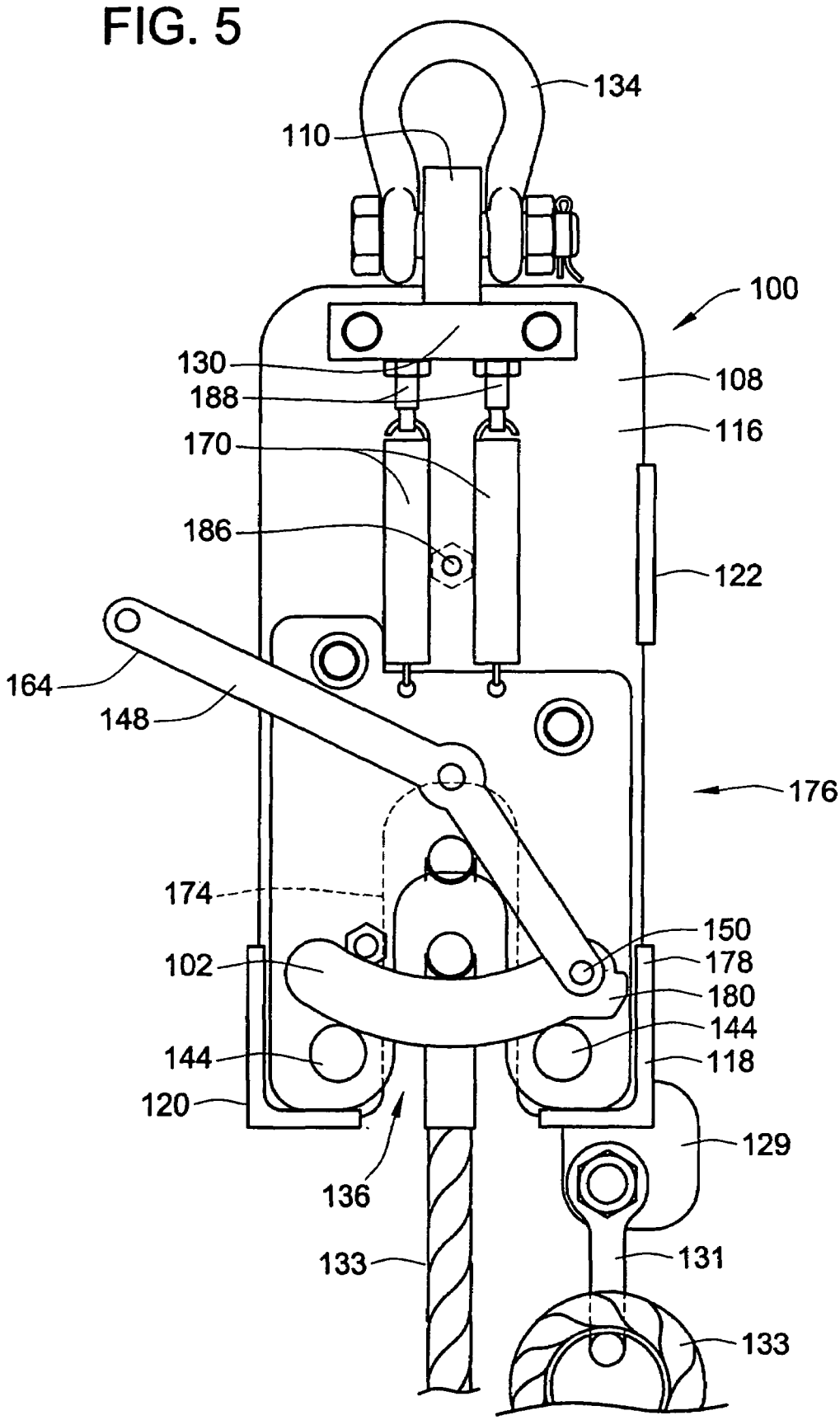
FIG. 5 is cross sectional view of the remote release of FIG. 1, looking from the front, with the remote release in closed-and-locked position.

FIGS. 1 and 2, respectively, show a front and left side view of a first exemplary embodiment of the invention, in the form of a remote release apparatus 100 having an arcuate shaped lift arm 102 operatively attached to a body 104, for selective movement of the lift arm 102, with respect to the body 104, along an arc 106, between an open position, as shown in FIG. 3, and a closed position, as shown in FIGS. 4 and 5.

As shown in FIGS. 1 and 2, the body 104 includes a body weldment 108 and shackle weldment 110, joined to one another by through bolts 112. The body weldment 108 includes front and back plates 114, 116, connected together in a spaced relationship to one another by a pair of right and left angle brackets 118, 120 and a rectangular bar 122. (Note that the rectangular bar 122 is not shown in FIG. 2 for clarity. This arrangement forms an elongated rectangular space 124 inside of the body weldment 108, for receiving an inner lift assembly 126 described in more detail below. The body weldment 108 further includes a pair of inner lift guides 128 having outer ends thereof attached to the inner wall of the rear side plate 116 of the body weldment 108, and having distal ends thereof, extending into the space 124 inside the body weldment 108, and adapted for guiding the inner lift assembly 126 as it moves up and down within the space 124 inside of the body 108. The body weldment 108 further includes an apertured load sling lug 129 attached to and extending from the right angle bracket 118, for attachment of a first end of a load sling 133 via a device such as a shackle 131.

The shackle weldment 110 includes a horizontally oriented cross plate 130 and a vertically oriented lug 132. The cross plate 130 has a width matching the spacing between the side plates 112, 116 of the body weldment 108, so that the shackle weldment 110 can be inserted into the space 124 at the upper ends of the side plates 112, 116, where it is held in place by the through bolts 112. The shackle weldment 110 is thus separable from the body weldment 108 to allow insertion of the inner lift assembly 126 into the body 104 of the remote release apparatus 100. The lug 132 includes a through hole for attachment thereto of an upper shackle 134, with the upper shackle 134 being adapted for operative attachment to a lifting device such as a crane.

The lower ends of the front and rear side plates 114, 116 of the body weldment 108 define matching elongated slots 136, which are open at the bottom edge of the body weldment 108, between the angle brackets 118, 120, as shown in FIGS. 1, and 3-5, for receiving a second end of the load sling 133 in the manner shown in FIGS. 4 and 5.

Figure 8:
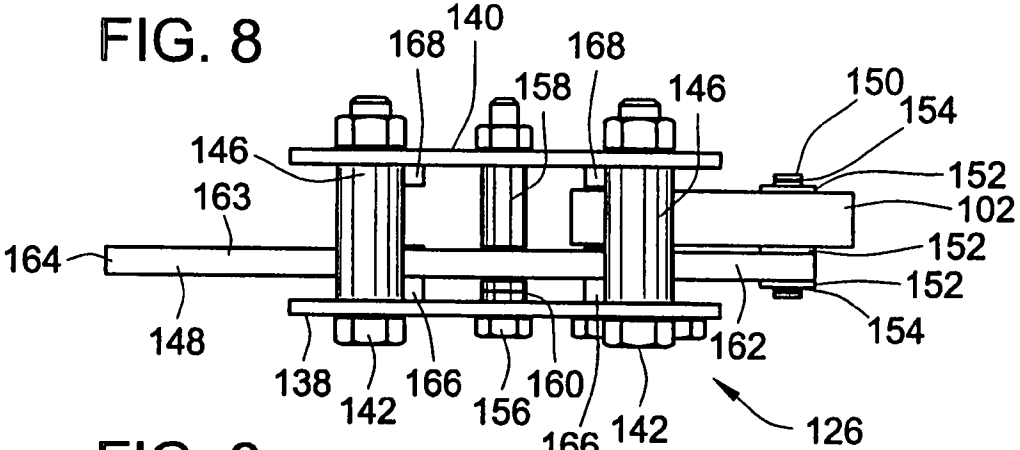
FIGS. 6-8 are front, left side, and top views, respectively, of an inner lift assembly of the remote release apparatus of FIG. 1.
Figure 6:
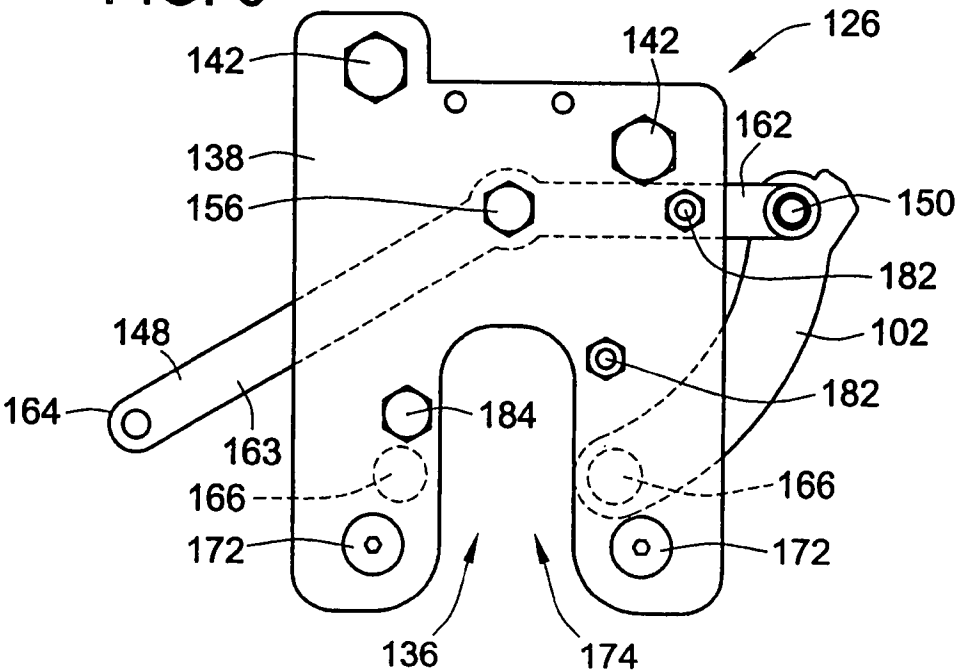
Figure 7:
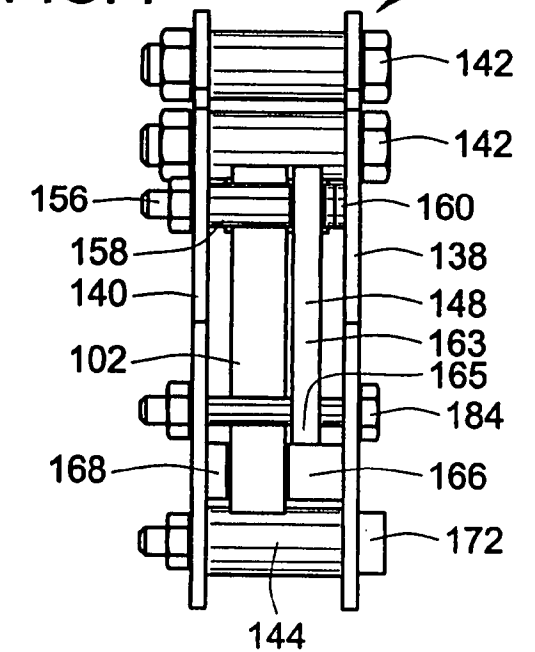

As best seen in FIGS. 6-8, the inner lift assembly 126 includes front and rear inner lift plates 138, 140 joined together adjacent an upper edge thereof, in a spaced relation to one another, by a pair of through bolts 142, and adjacent a lower edge thereof, in the spaced relationship by a pair of shoulder bolts 144. Spacers 146 are disposed around the through bolts 142 and between the inner lift plates 138, 140, with the spacers 146, in conjunction with the shoulder bolts 144, maintaining the inner lift plates 138, 140 in a properly spaced relationship to one another.

The right end (as shown in FIGS. 1 and 3-7) of the lift arm 102 is pivotably joined to a pivot link 148 by a lift arm pin 150, bronze washers 152 and snap rings 154. The pivot link 148 is in turn pivotably attached to and between the front and rear inner lift plates 138, 148 by a pivot bolt 156. A pivot link spacer 158 and flat washers 160 are disposed about the pivot bolt 156, for maintaining the pivot link 148 in a desired position with relation to the front and rear inner lift plates 138, 140 and the lift arm 102, as shown in FIGS. 7 and 8.

The pivot link 148 includes a first section 162 thereof, extending between the pivot bolt 156 and the lift arm pin 150. The pivot link 148 also includes a second section 163 thereof, having a first end attached to the first section 162 of the pivot link 148 at a point adjacent the pivot bolt 156 and extending outward from the pivot bolt 156 to a distal end 164 of the pivot link 148. The distal end 164 of the pivot link 148 includes an aperture for attachment of a release rope (not shown).

By virtue of this arrangement, the lift arm 102 can be moved along the arc shaped path 106 from the open position shown in FIGS. 3 and 6, to the closed position shown in FIGS. 4 and 5, by moving the distal end 164 of the pivot link 148 in a counter-clockwise direction (as shown in FIGS. 1 and 3-6) about the pivot bolt 156. Conversely, the lift arm 102 can be moved along the arc shaped path 106 from the closed position shown in FIGS. 4 and 5, to the open position shown in FIGS. 3 and 6, by moving the distal end 164 of the pivot link 148 in a clockwise direction (as shown in FIGS. 1 and 3-6) about the pivot bolt 156. A pair of long spacers 166, attached to the front inner lift plate 138, and a pair of short spacers 168, attached to the rear inner lift plate 140, act as guides for the lift arm 102 as it traverses the arc shaped path 106, between the open position shown in FIGS. 3 and 6, and the closed position shown in FIGS. 4 and 5.

As shown in FIGS. 1-5, the inner lift assembly 126 is suspended from the shackle weldment 110, within the elongated rectangular space 124 in the body weldment 108, by a pair of extension springs 170 that are operatively attached between the inner lift assembly 126 and the shackle weldment 110, for urging the inner lift assembly 126 to move upward, within the space 124 in the body weldment 108, toward the shackle weldment 110.

The right ends (as shown in FIGS. 2-7) of the shoulder bolts 144 are configured to form guides 172, extending through the front inner lift plate 138, that guide the inner lift assembly 126 and space it from the inner wall of the front inner lift plate 138, as the inner lift assembly 126 moves toward and away from the shackle weldment 110 within the space 124 between the front and rear inner lift plates 138, 140. In similar fashion, the inner lift guides 128 guide and space the inner lift assembly 126 from the inner wall of the rear inner lift plate 140, as the inner lift assembly 126 moves toward and away from the shackle weldment 110 within the space 124 between the front and rear inner lift plates 138, 140.

As shown in FIGS. 1 and 3-6, the lower ends of the front and rear side plates 138, 140 of the inner lift assembly 126 define matching elongated slots 174, which are open at the bottom edge of the inner lift assembly 126, for receiving the second end of the load sling 133 in the manner shown in FIGS. 4 and 5.

Operation of the exemplary embodiment of the load release apparatus 100, and further structural aspects, are illustrated in FIGS. 3-5. As shown in FIG. 3, with the load release apparatus 100 suspended from a lifting apparatus, such as a crane, by the upper shackle 134, the distal end 164 of the pivot link 148 is rotated in a counter-clockwise direction (downward as shown in FIG. 3) about the pivot bolt 156 to move the arcuate shaped lift arm 102 along the arc-shaped path 106 to the open position, so that the second end of the load sling 133, wrapped around the load, may be inserted into the elongated slots 136, 174 in the body weldment 108 and the inner lift assembly 126, in the manner shown in FIG. 4.

As shown in FIG. 4, with the second end of the load sling 133 properly positioned in the elongated slots 136, 174 in the body weldment 108 and the inner lift assembly 126, the distal end 164 of the pivot link 148 is rotated in a clockwise direction (upward as shown in FIG. 4) about the pivot bolt 156 to move the arcuate shaped lift arm 102 along the arc-shaped path 106 to the closed position, so that the second end of the load sling 133 is engaged by the lift arm 102. The lower surface of the lift arm 102, and the portion of the shoulder bolts 144 between the front and rear inner lift plates 138, 140 of the inner lift assembly, are configured and placed in a complimentary manner, with respect to one another, such that when the remote release apparatus 100 is in the closed position, the lower surface of the lift arm 102 bears against the portion of the shoulder bolts 144 between the front and rear inner lift plates 138, 140 of the inner lift assembly 126.

As the load is lifted by the crane attached to the upper shackle 134, the remote release apparatus 100 moves upward, to a point where the sling 133 begins to transfer weight from the load to the lift arm 102, which in turn transfers the weight to the inner lift assembly 126 through the shoulder bolts 144.

As the crane continues to lift, beyond the point at which the weight of the load begins to be transferred to the inner lift assembly 126, the springs 170 begin to extend and allow the body 104 of the remote release apparatus 100 to continue moving upward with the crane, while the inner lift assembly 126 remains stationary with respect to the load.

Eventually, as the crane continues to lift the body 104 of the remote release apparatus 100, the lower end of the inner lift assembly 126 comes into contact with the upper surfaces of horizontally extending legs of the right and left angle brackets 118, 120, as shown in FIG. 5, and the weight of the load is transferred through the sling 133 to the lift arm 102, from the lift arm 102 to the inner lift assembly through the shoulder bolts 144, and into the body 104 of the remote lifting apparatus 100 from the inner lift assembly 126.

Once the lower end of the inner lift assembly 126 comes into contact with the upper surfaces of the horizontal legs of the left and right angle brackets 118, 120, the angle brackets 118, 120 prevent any further relative movement between the inner lift assembly and the body 104 of the remote release apparatus 100, so that as the crane continues to lift, the load is lifted from its initial position of rest.

As will be understood from FIGS. 1 and 3-5, the right angle bracket 118 and rectangular bar 122 are positioned and attached to the front and rear side plates 114, 116 of the body weldment 108 in such a manner that an elongated gap 176 is created between the lower edge of the rectangular bar 122 and an upper edge of a vertically extending leg 178 of the right angle bracket 118, for passage therethrough of the end of the lift arm 102 that is pivotably attached by the lift arm pin 150 to the pivot bracket 148. The end of the lift arm 102 adjacent the lift arm pin 150 also includes a locking lug 180, extending outwardly therefrom, for engaging the inner surface of the vertically extending leg 178 of the right angle bracket 118.

The locking lug 180 is configured and located to preclude movement of the lift arm 102 along the arc 106 from the closed to the open position, whenever the application of weight from the load has pulled the inner lift assembly 126 downward to the point where the locking lug 180 has moved below the upper edge of the vertically extending leg 178 of the right angle bracket 118.

By virtue of this construction, therefore, the remote release apparatus 100 is locked in the closed position while the load is being lifted, and the lift arm 102 cannot be moved from the closed to the open position until the weight acting on the lift arm 102 has been relieved to a low enough value that the springs 170 can pull the inner lift assembly 126 upward within the body 104 to the point where the locking lug 180 is once again positioned above the upper end of the vertically extending leg 178 of the right angle bracket 118. Once the locking lug 180 enters the gap 176 in the body weldment 108, above the upper edge of the vertical leg 178 of the right angle bracket, the lift arm 102 can once again be moved along the arc 106 to the open position by pulling downward on the distal end 164 of the pivot link 148. As the lift arm 102 moves to the open position, the second end of the sling 133 is released, so that it can be pulled out of the slots 136, 174 in the body 104 and inner lift assembly 126, to release the load from the sling 133.

Because the weight on the lift arm 102 is only relieved when the load is fully supported in either its initial or final position, the locking provisions of the exemplary embodiment of the remote release apparatus 100, therefore, preclude inadvertent release of the load while it is being lifted.

As shown in FIG. 6, the exemplary embodiment of the remote release apparatus 100, may also include a pair of adjustable spring loaded detent devices 182, having a spring loaded ball (not shown) for engaging a hole or recess (not shown) in the second portion 162 of the pivot link 148, to selectively hold the remote release apparatus 100 in either the open or the closed position. In other embodiments, however, other types of devices may be used for holding the remote release apparatus 100 in either or both of the open or closed positions, and in yet other embodiments, such holding devices may be omitted entirely. In some embodiments without such holding devices, various components of the remote release apparatus, such as the lift arm and pivot link, for example, may be designed such that gravitational force will tend to move the lift arm toward the closed position.

As best seen in FIGS. 6 and 7, the inner lift assembly 126 of the remote lift apparatus 100 also includes a lift arm upper surface guide 184, in the form of a through bolt attached to the front and rear inner lift plates 138, 140 at a point above the long and short spacers 166, 168, for precluding upward rotation of the distal end of the lift arm 102, when the lift arm 102 is positioned at, or is approaching the closed position.

As shown in FIGS. 1 and 3-5, the remote release apparatus 100 includes an upper stop bolt 186, extending through the body 104 for limiting the extent of upward movement of the inner lift assembly 126 within the body 104. The extension springs 170 are operatively attached to the shackle weldment 110 with spring tension adjusters 188 that allow the preload in the springs 170 to be adjusted, with the inner lift apparatus 126 bearing against the upper stop bolt 186. By virtue of this arrangement, the spring force can be adjusted to accommodate slings 133 of various weights, so that the weight of the sling 133 alone, acting on the lift arm 102, will not pull the inner lift assembly 126 down into the closed and locked position. Said another way, the springs 170 are adjusted to have sufficient preload that they will pull the inner lift assembly 126 and second end of the sling 133 upward from the closed and locked position, to a position where the lift arm 102 can be moved to the open position, when the load sling 133 is essentially slack and not under tension from supporting the load.

It is also contemplated that in some forms of the invention, it may be desirable to have one or more components, such as the pivot link 148 or the lift arm pin 150 designed to deform or shear in the event that excessive force is applied to the distal end 164 of the pivot link 148 while the lift arm 102 is in the closed and locked position, to further preclude inadvertent opening of the remote release apparatus 100 while it is supporting the load.

Figure 9:
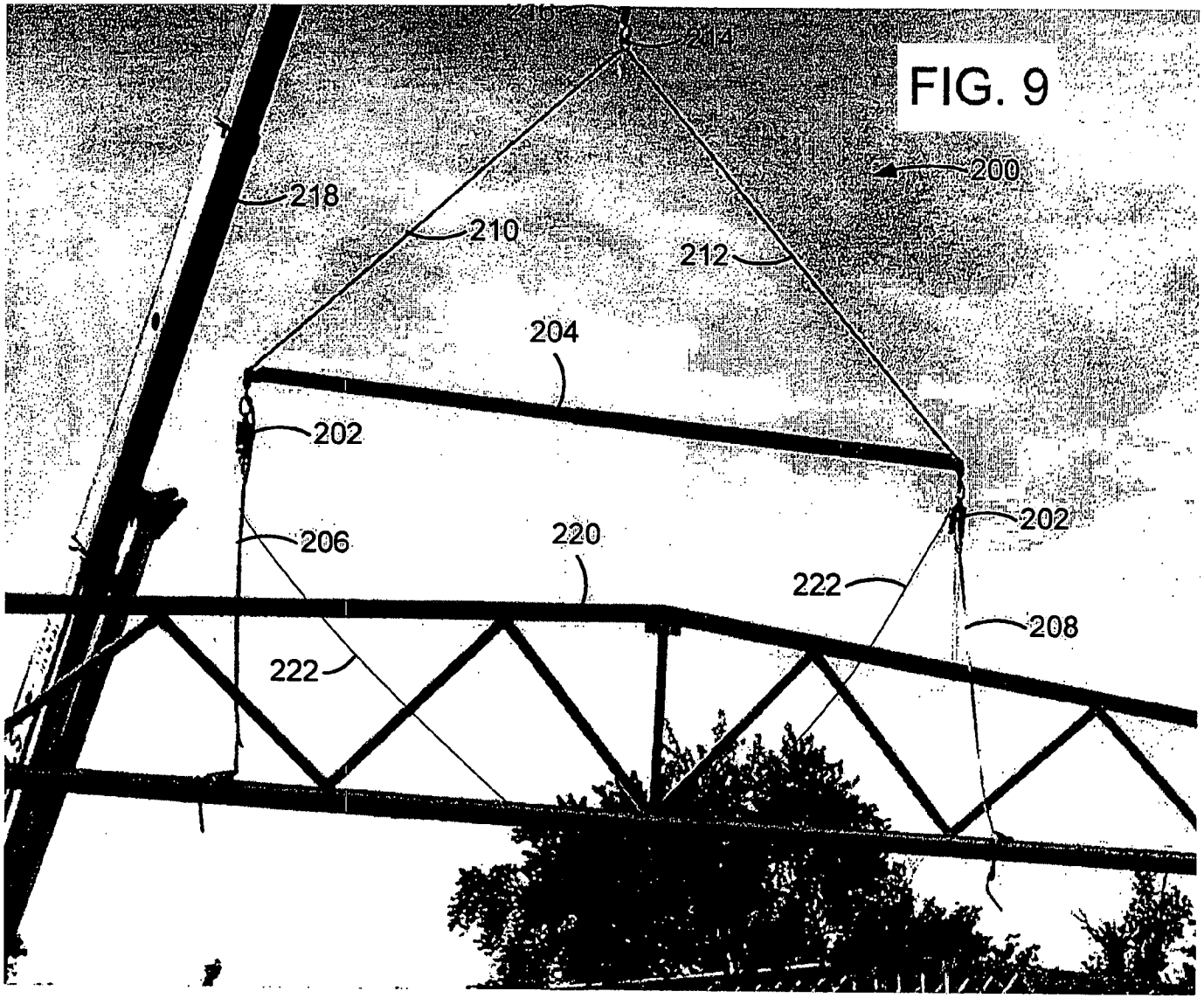
FIGS. 9 and 10 are photographs of an exemplary embodiment of a lifting apparatus, according to the invention.
Figure 10:
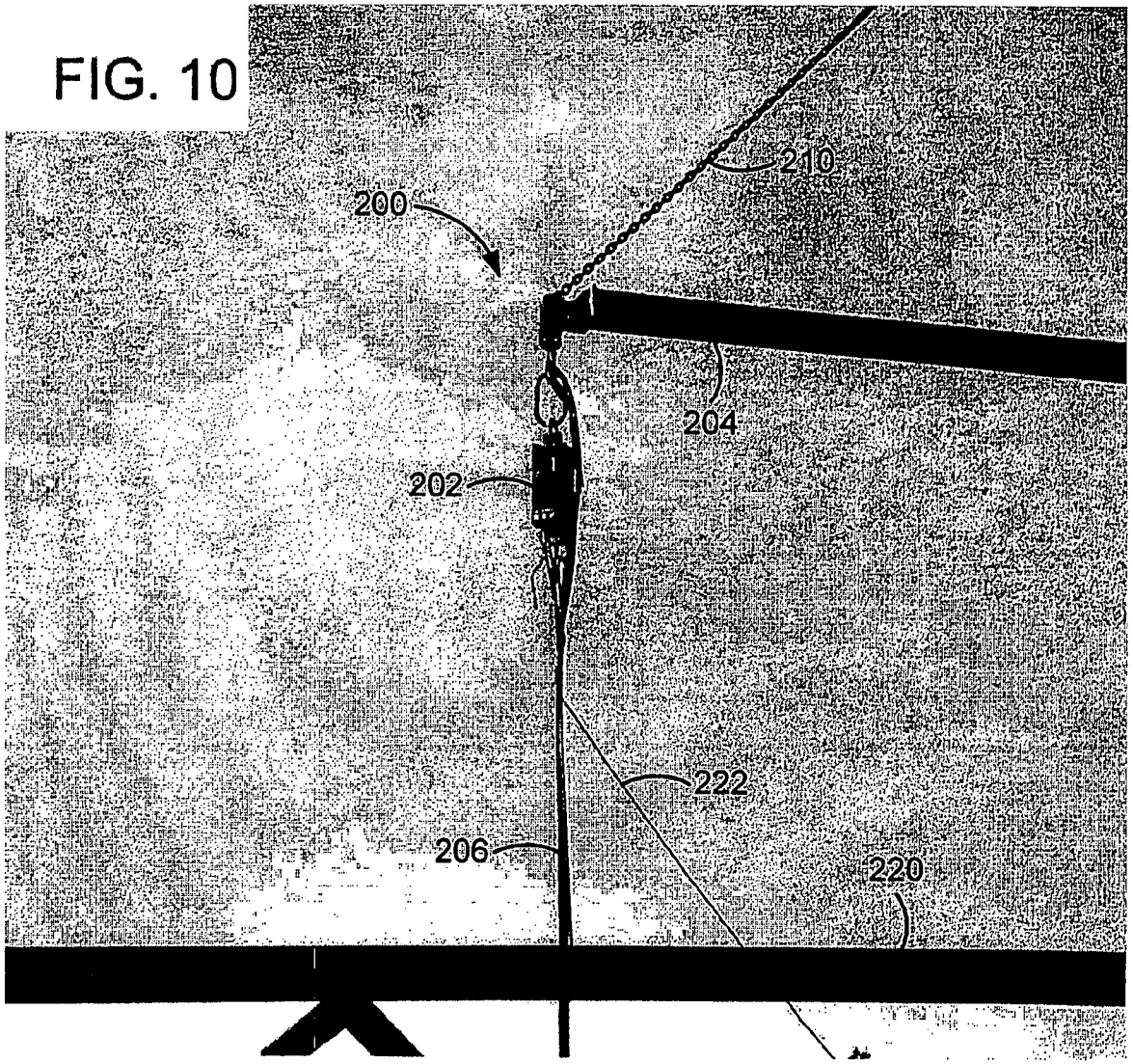

FIGS. 9 and 10 illustrate a second exemplary embodiment of the invention in the form of a lifting apparatus 200. The lifting apparatus 200 includes a pair of remote release apparatuses 202, attached at alternate ends of a spreader bar 204, a first and a second load sling 206, 208, and a pair of lift slings 210, 212, each having one end attached to a respective end of the spreader bar 204, and having opposite ends which are joined together at a lifting ring 214 adapted for attachment to a hook 216 of a crane 218. The load release apparatuses 202 of the lifting apparatus 200 are essentially identical to the remote release 100 described above in regard to the first exemplary embodiment. In FIGS. 9 and 10, the lifting apparatus 200 is shown lifting a truss 220 supported by the load slings 206, 208. As best seen in FIG. 10, the lifting apparatus 200 further includes a release rope or cable 222 operatively attached to the remote release apparatuses 202 for releasing the load slings 206, 208, once the truss 220 is set into place.

The use of the terms "a" and "an" and "the" and similar referents in the context of describing the invention are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any element not expressly described herein as being essential to the practice of the invention. For example, the use of the term "weldment" in context with describing certain preferred embodiments of the invention is not intended to limit the invention to structures constructed by welding, or to structures formed from multiple components.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventor intend for the invention to be practiced otherwise than as specifically described herein. For example a remote release apparatus or method, according to the invention, may include an actuator, controlled through wires or wirelessly from a controller located remotely from the remote release apparatus, rather than the rope, cord chain, or other tension element described above in relation to the exemplary embodiments.

Accordingly, this invention includes all modifications and equivalents of the subject matter recited or suggested herein as permitted by applicable law. Moreover, any combination of the above-described elements in all possible variations thereof is encompassed by the invention unless otherwise indicated herein or otherwise clearly contradicted by context.

All references, including publications, patent applications, and patents cited herein are hereby incorporated by reference to the same extent as if each reference were individually and specifically indicated to be incorporated by reference and were set forth in its entirety herein.

What is claimed is:

1. A release apparatus, for selectively engaging and lifting a load, the release apparatus comprising:

a body; and an inner lift apparatus including a lift arm operatively attached to the body for selective movement of the lift arm along an arc, in such a manner that the lift arm selectively engages with, and disengages from, the load;

the inner lift apparatus, including a movable frame and a pivot link connected to the frame at a pivot point of the pivot link, with the lift arm being operatively connected to the movable frame and the pivot link in such a manner that as the pivot arm is selectively pivoted about the pivot point, the lift arm is moved between closed and open positions of the release apparatus;

the body defining a first end and a second end thereof, with the first end thereof including an attachment element, for suspending the release apparatus from a lifting device, and the second end thereof including an outwardly opening slot therein intersected by the arc along which the lift arm may be selectively moved, in such a manner that, in the closed position the lift arm extends across the slot and is supported by the movable frame in such a manner that the slot and lift arm in combination form a closed pintle-like receptacle for securing the load to the lift arm, and in the open position the lift arm does not fully intersect the slot, to thereby preclude engagement of the load by the lift arm;

the body also defining an elongated internal space for sliding receipt therein and guidance of the movable frame along a substantially linear path in a direction transverse to the arc toward and away from the second end of the body.

2. The release apparatus of claim 1, further comprising, a locking apparatus for locking the lift arm against movement along the arc while the release apparatus is supporting the load on the lift arm.

3. The release apparatus of claim 2, wherein the lift arm is movable along the arc from a closed to an open position of the release apparatus, and the locking apparatus selectively locks the lift arm in place along the arc in the closed position, while the release apparatus is supporting the load on the lift arm.

4. The release apparatus of claim 2, wherein, the locking apparatus is engaged by the load pulling the lift arm in a direction transverse to the arc.

5. The release apparatus of claim 4, wherein, the lift arm remains locked by the locking apparatus, in the closed position, until the load pulling the lift arm in the direction transverse to the arc is reduced below a predetermined magnitude of the load, below which the lift arm may be selectively moved to the open position.

6. The release apparatus of claim 5, wherein the lift arm is movable along the arc from a closed to an open position of the release apparatus, and the release apparatus further comprises, a second locking apparatus, for selectively locking the lift arm in place along the arc at the open position of the lifting apparatus.

7. The release apparatus of claim 1, further comprising, a remote release mechanism, operatively connected between the body and the lift arm in such a manner that the remote release mechanism is operable from a location remote from the remote release apparatus, for selectively moving the lift arm along the arc to thereby selectively engage and disengage the lift arm from the load.

8. The release apparatus of claim 7, further comprising, a locking apparatus for locking the lift arm against movement along the arc while the release apparatus is supporting the load on the lift arm.

9. The release apparatus of claim 8, wherein the lift arm is movable along the arc from a closed to an open position of the release apparatus, and the locking apparatus selectively locks the lift arm in place along the arc in the closed position, while the release apparatus is supporting the load on the lift arm.

10. The release apparatus of claim 9, wherein, the locking apparatus is engaged by the load pulling the lift arm in a direction transverse to the arc.

11. The release apparatus of claim 10, wherein, the lift arm remains locked by the locking apparatus, in the closed position, until the load pulling the lift arm in the direction transverse to the arc is reduced below a predetermined magnitude of the load, below which the lift arm may be selectively moved to the open position.

12. The release apparatus of claim 7, wherein the lift arm is movable along the arc from a closed to an open position of the release apparatus, and the release apparatus further comprises, a second locking apparatus, for selectively locking the lift arm in place along the arc at the open position of the lifting apparatus.

13. The release apparatus of claim 1, wherein, the inner lift apparatus also comprises a biasing element operatively connected between the body and the movable frame for urging the movable frame to travel, within the elongated internal space, toward the first end of the body, the biasing element exerting a biasing force in opposition to the load having a magnitude less than the load.

14. The release apparatus of claim 1, wherein the body further comprises:

a linear stop for precluding further linear travel of the movable frame toward the second end of the body at a predetermined maximum distance of relative travel between the body and the movable frame, when the release apparatus is in the closed position with the load bearing on the lift arm;

a lift arm travel stop for precluding movement of the lift arm along the arc from the closed to the open position within a predetermined proximity of the lift arm to the second end of the body;

a linear stop for precluding further linear travel of the movable frame toward the second end of the body at a predetermined maximum distance of relative travel between the body and the movable frame, when the release apparatus is in the closed position with the load bearing on the lift arm; and a lift arm travel stop for precluding movement of the lift arm along the arc from the closed to the open position within a predetermined proximity of the lift arm to the second end of the body.

15. The remote release apparatus of claim 1, wherein:

the inner lift apparatus also comprises a biasing element operatively connected between the body and the movable frame for urging the movable frame to travel, within the elongated internal space, toward the first end of the body, the biasing element exerting a biasing force in opposition to the load having a magnitude less than the load;

the body includes a linear stop for precluding further linear travel of the movable frame toward the second end of the body at a predetermined maximum distance of relative travel between the body and the movable frame, when the release apparatus is in the closed position with the load bearing on the lift arm;

the body also includes a lift arm travel stop for precluding movement of the lift arm along the arc from the closed to the open position within a predetermined proximity of the lift arm to the second end of the body;

the body further includes a linear stop for precluding further linear travel of the movable frame toward the second end of the body at a predetermined maximum distance of relative travel between the body and the movable frame, when the release apparatus is in the closed position with the load bearing on the lift arm;

the body yet further includes a lift arm travel stop for precluding movement of the lift arm along the arc from the closed to the open position within a predetermined proximity of the lift arm to the second end of the body.

16. A method for selectively engaging and lifting a load, the method comprising:

connecting the load to a release apparatus, and lifting the load with the load at least partially suspended by the release apparatus;

wherein, the release apparatus comprises:

a body; and an inner lift assembly including a lift arm operatively attached to the body for selective movement of the lift arm along an arc, in such a manner that the lift arm selectively engages with, and disengages from, the load;

the inner lift assembly, including a movable frame and a pivot link connected to the frame at a pivot point of the pivot link, with the lift arm being operatively connected to the movable frame and the pivot link in such a manner that as the pivot arm is selectively pivoted about the pivot point, the lift arm is moved between the closed and open positions of the release apparatus;

the body defining a first end and a second end thereof, with the first end thereof including an attachment element, for suspending the release apparatus from a lifting device, and the second end thereof including an outwardly opening slot therein intersected by the arc along which the lift arm may be selectively moved, in such a manner that, in the closed position the lift arm extends across the slot and is supported by the movable frame in such a manner that the slot and lift arm in combination form a closed pintle-like receptacle for securing the load to the lift arm, and in the open position the lift arm does not fully intersect the slot, to thereby preclude engagement of the load by the lift arm;

the body also defining an elongated internal space for sliding receipt therein and guidance of the movable frame along a substantially linear path in a direction transverse to the arc toward and away from the second end of the body.

17. The method of claim 16, further comprising, operatively connecting a remote release mechanism, between the body and the lift arm, and selectively moving the lift arm along the arc from a location remote from the release apparatus.

18. The method of claim 17, further comprising, operatively connecting a locking apparatus between the body and the lift arm for locking the lift arm against movement along the arc while the release apparatus is supporting the load on the lift arm.

19. The method of claim 18, wherein, the lift arm is movable along the arc from a closed to an open position of the release apparatus, and the locking apparatus selectively locks the lift arm in place along the arc in the closed position, while the release apparatus is supporting the load on the lift arm, and the method further comprises locking the lift arm in place along the arc in the closed position by supporting the load on the lift arm.

20. The method of claim 19, wherein, the locking apparatus is engaged by the load pulling the lift arm in a direction transverse to the arc, and the method further comprises engaging the load.

21. The method of claim 20, wherein, the lift arm remains locked by the locking apparatus, in the closed position, until the load pulling the lift arm in the direction transverse to the arc is reduced below a predetermined magnitude of the load, below which the lift arm may be selectively moved to the open position, and the method further comprises controlling the load pulling on the lift arm in the direction transverse to the arc to a desired magnitude with respect to the predetermined magnitude.

22. The method of claim 21, wherein, the lift arm is movable along the arc from a closed to an open position of the release apparatus, and the release apparatus further comprises, a second locking apparatus, for selectively locking the lift arm in place along the arc at the open position of the lifting apparatus, and the method further comprises selectively operating the second locking apparatus to lock the lift arm in the open position.

23. A lifting apparatus for lifting a load, the lifting apparatus comprising:

a spreader bar, and at least one remote release apparatus operatively connected to the spreader bar;

the remote release apparatus having a body and an inner lift assembly including a lift arm operatively attached to the body for selective movement of the lift arm along an arc, in such a manner that the lift arm selectively engages with, and disengages from, the load;

the inner lift assembly, including a movable frame and a pivot link connected to the frame at a pivot point of the pivot link, with the lift arm being operatively connected to the movable frame and the pivot link in such a manner that as the pivot arm is selectively pivoted about the pivot point, the lift arm is moved between the closed and open positions of the release apparatus;

the body defining a first end and a second end thereof, with the first end thereof including an attachment element, for suspending the release apparatus from a lifting device, and the second end thereof including an outwardly opening slot therein intersected by the arc along which the lift arm may be selectively moved, in such a manner that, in the closed position the lift arm extends across the slot and is supported by the movable frame in such a manner that the slot and lift arm in combination form a closed pintle-like receptacle for securing the load to the lift arm, and in the open position the lift arm does not fully intersect the slot, to thereby preclude engagement of the load by the lift arm;

the body also defining an elongated internal space for sliding receipt therein and guidance of the movable frame along a substantially linear path in a direction transverse to the arc toward and away from the second end of the body;

the remote release apparatus further having a remote release mechanism which is selectively operable in response to an input supplied from a location remote from the remote release apparatus, the remote release apparatus being operatively connected between the body and the lift arm, for selectively moving the lift arm along the arc, in response to the remotely supplied input.

24. The lifting apparatus of claim 23, wherein the remote release apparatus further comprises, a locking apparatus for locking the lift arm against movement along the arc while the lifting apparatus is supporting the load on the lift arm of the remote release apparatus.

25. The lifting apparatus of claim 24, wherein the lift arm of the remote release apparatus is movable along the arc from a closed to an open position of the release apparatus, and the locking apparatus selectively locks the lift arm in place along the arc in the closed position, while the lifting apparatus is supporting the load on the lift arm of the remote release apparatus.

26. The lifting apparatus of claim 24, wherein, the locking apparatus is engaged by the load pulling the lift arm in a direction transverse to the arc.

27. The lifting apparatus of claim 26, wherein, the lift arm of the remote release apparatus remains locked by the locking apparatus, in the closed position, regardless of the input being to the contrary, until the load pulling the lift arm in the direction transverse to the arc is reduced below a predetermined magnitude of the load, below which the lift arm may be selectively moved to the open position.

28. The lifting apparatus of claim 27, wherein the lift arm of the remote release apparatus is movable along the arc from a closed to an open position of the release apparatus, in response to the input, and the release apparatus further comprises, a second locking apparatus, for selectively locking the lift arm in place along the arc at the open position of the lifting apparatus.

29. A remote release apparatus, for selectively engaging, lifting and releasing a load applied to the apparatus, the remote release apparatus comprising:

a body;

an inner lift assembly including a lift arm operatively attached to the body for selective movement of the lift arm along an arc, from a closed to an open position of the remote release apparatus, in such a manner that the lift arm selectively engages, and disengages from, the load;

a remote release mechanism, operatively connected between the body and the lift arm, for controlling operation of the remote release apparatus from a location remote from the release apparatus, by selectively moving the lift arm along the arc; and a first locking apparatus for locking the lift arm against movement along the arc while the release apparatus is supporting the load on the lift arm;

the inner lift assembly, including a movable frame and a pivot link connected to the frame at a pivot point of the pivot link, with the lift arm being operatively connected to the movable frame and the pivot link in such a manner that as the pivot arm is selectively pivoted about the pivot point, the lift arm is moved between the closed and open positions of the release apparatus;

the body defining a first end and a second end thereof, with the first end thereof including an attachment element, for suspending the release apparatus from a lifting device, and the second end thereof including an outwardly opening slot therein intersected by the arc along which the lift arm may be selectively moved, in such a manner that, in the closed position the lift arm extends across the slot and is supported by the movable frame in such a manner that the slot and lift arm in combination form a closed pintle-like receptacle for securing the load to the lift arm, and in the open position the lift arm does not fully intersect the slot, to thereby preclude engagement of the load by the lift arm;

the body also defining an elongated internal space for sliding receipt therein and guidance of the movable frame along a substantially linear path in a direction transverse to the arc toward and away from the second end of the body.

30. The remote release apparatus of claim 29, further comprising, a second locking apparatus, for selectively locking the lift arm in place along the arc at the open position of the lifting apparatus.

31. The remote release apparatus of claim 29, wherein, the lift arm includes an arcuate-shaped lifting surface, extending substantially parallel to the arc, for supporting the load.

32. The release apparatus of claim 31, wherein, the lift arm remains locked by the first locking apparatus, in the closed position, until the load pulling the lift arm in the direction transverse to the arc is reduced below a predetermined magnitude of the load, below which the lift arm may be selectively moved to the open position.

33. The release apparatus of claim 29, wherein, the first locking apparatus is engaged by the load pulling the lift arm in a direction transverse to the arc.

34. The release apparatus of claim 29, wherein, the inner lift assembly also comprises a biasing element operatively connected between the body and the movable frame for urging the movable frame to travel, within the elongated internal space, toward the first end of the body, the biasing element exerting a biasing force in opposition to the load having a magnitude less than the load.

35. The release apparatus of claim 29, wherein the body further comprises:

a linear stop for precluding further linear travel of the movable frame toward the second end of the body at a predetermined maximum distance of relative travel between the body and the movable frame, when the release apparatus is in the closed position with the load bearing on the lift arm;

a lift arm travel stop for precluding movement of the lift arm along the arc from the closed to the open position within a predetermined proximity of the lift arm to the second end of the body;

a linear stop for precluding further linear travel of the movable frame toward the second end of the body at a predetermined maximum distance of relative travel between the body and the movable frame, when the release apparatus is in the closed position with the load bearing on the lift arm; and a lift arm travel stop for precluding movement of the lift arm along the arc from the closed to the open position within a predetermined proximity of the lift arm to the second end of the body.

36. The remote release apparatus of claim 29, wherein:

the inner lift assembly also comprises a biasing element operatively connected between the body and the movable frame for urging the movable frame to travel, within the elongated internal space, toward the first end of the body, the biasing element exerting a biasing force in opposition to the load having a magnitude less than the load;

the body includes a linear stop for precluding further linear travel of the movable frame toward the second end of the body at a predetermined maximum distance of relative travel between the body and the movable frame, when the release apparatus is in the closed position with the load bearing on the lift arm;

the body also includes a lift arm travel stop for precluding movement of the lift arm along the arc from the closed to the open position within a predetermined proximity of the lift arm to the second end of the body;

the body further includes a linear stop for precluding further linear travel of the movable frame toward the second end of the body at a predetermined maximum distance of relative travel between the body and the movable frame, when the release apparatus is in the closed position with the load bearing on the lift arm;

the body yet further includes a lift arm travel stop for precluding movement of the lift arm along the arc from the closed to the open position within a predetermined proximity of the lift arm to the second end of the body.

37. A remote release apparatus, for selectively engaging, lifting and releasing a load applied to the apparatus, the remote release apparatus comprising:

a body;

an inner lift assembly including a lift arm operatively attached to the body for selective movement of the lift arm along an arc, from a closed to an open position of the remote release apparatus, in such a manner that the lift arm selectively engages, and disengages from, the load;

a remote release mechanism, operatively connected between the body and the lift arm, for controlling operation of the remote release apparatus from a location remote from the release apparatus, by selectively moving the lift arm along the arc; and a first locking apparatus for locking the lift arm against movement along the arc while the release apparatus is supporting the load on the lift arm;

the lift arm including an arcuate-shaped lifting surface, extending substantially parallel to the arc, for supporting the load;

the lift arm remaining locked by the first locking apparatus, in the closed position, until the load pulling the lift arm in the direction transverse to the arc is reduced below a predetermined magnitude of the load, below which the lift arm may be selectively moved to the open position;

the inner lift assembly, also including a movable frame and a pivot link connected to the frame at a pivot point of the pivot link, with the lift arm being operatively connected to the movable frame and the pivot link in such a manner that as the pivot arm is selectively pivoted about the pivot point, the lift arm is moved between the closed and open positions of the release apparatus;

the body defining a first end and a second end thereof, with the first end thereof including an attachment element, for suspending the release apparatus from a lifting device, and the second end thereof including an outwardly opening slot therein intersected by the arc along which the lift arm may be selectively moved, in such a manner that, in the closed position the lift arm extends across the slot and is supported by the movable frame in such a manner that the slot and lift arm in combination form a closed pintle-like receptacle for securing the load to the lift arm, and in the open position the lift arm does not fully intersect the slot, to thereby preclude engagement of the load by the lift arm;

the body also defining an elongated internal space for sliding receipt therein and guidance of the movable frame along a substantially linear path in a direction transverse to the arc toward and away from the second end of the body;

inner lift assembly further including a biasing element operatively connected between the body and the movable frame for urging the movable frame to travel, within the elongated internal space, toward the first end of the body, the biasing element exerting a biasing force in opposition to the load having a magnitude less than the load;

the body further including a linear stop for precluding further linear travel of the movable frame toward the second end of the body at a predetermined maximum distance of relative travel between the body and the movable frame, when the release apparatus is in the closed position with the load bearing on the lift arm; and the body also further including a lift arm travel stop for precluding movement of the lift arm along the arc from the closed to the open position within a predetermined proximity of the lift arm to the second end of the body.

38. The remote release apparatus of claim 37, wherein, the pivot link includes an attachment feature for attachment thereto of a tension bearing element for selectively moving the lift arm from the closed to the open position through application of tension to the tension bearing element from a location remote to the remote release apparatus.

39. The remote release apparatus of claim 37, wherein, the pivot link is configured and/or operatively connected to the movable frame and/or the lift arm in such a manner that an element of the remote release apparatus will disconnect through shearing, in the event that excessive force is applied to the pivot arm when the lift arm is locked by the lift arm travel stop against movement from the open to the closed position of the release apparatus.

* * * * *